US005310175A

United States Patent [19]

Riss et al.

[11] Patent Number: 5,310,175

[45] Date of Patent: May 10, 1994

[54] SEWING SYSTEM HAVING A DEVICE FOR THE PRECISE EDGE ALIGNMENT OF SEWING MATERIAL ALONG A STOP STRAIGHTEDGE

[75] Inventors: Gerhard Riss; Rainer P. Horst, both of Bielefeld; Heinz Lengel, Mammelsdorf, all of Fed. Rep. of Germany

[73] Assignee: Durkopp Adler Aktiengesellschaft, Fed. Rep. of Germany

[21] Appl. No.: 885,309

[22] Filed: May 18, 1992

[30] Foreign Application Priority Data

May 17, 1991 [DE] Fed. Rep. of Germany ..... 4116211

[51] Int. Cl.[5] ..... B65H 9/16

[52] U.S. Cl. ..... 271/250; 271/253

[58] Field of Search ..... 271/250, 253, 248, 226; 112/136, 141, 143, 147, 148, 152, 153, DIG. 2, DIG. 3

[56] References Cited

U.S. PATENT DOCUMENTS 3,825,250 7/1974 Miller ..... 271/250
4,590,876 5/1986 Mencke et al. ..... 112/262.3

FOREIGN PATENT DOCUMENTS 1179561 10/1964 Fed. Rep. of Germany ..... 271/250
2365216 7/1974 Fed. Rep. of Germany .
3325389 1/1985 Fed. Rep. of Germany .
3819277 6/1988 Fed. Rep. of Germany .
8807378 9/1988 Fed. Rep. of Germany .

*Primary Examiner*—David H. Bollinger
*Attorney, Agent, or Firm*—Ostrolenk, Faber, Gerb & Soffen

[57] ABSTRACT

A device for the precise edge alignment and shift-free transfer of sewing material includes a feed device, a clamping carriage, and a swingably mounted stop straightedge. The material is manually placed in the feed device, between lowerable clamping tongues and a substantially flat support arm, in such a manner that its forward edge, which is to be aligned, is located in the vicinity of the stop straightedge, which is temporarily swung upward for aligning the material. The stop straightedge has a vacuum chamber which exerts suction on the material, and the suction action is further intensified by jets of air which emerge from the bottoms of the clamping tongues and are directed obliquely to the stop straightedge. In this way, the edge of the material is aligned precisely along the stop straightedge, without contact by the operator. Thereupon the aligned material is transferred forward, without shifting, to a position beneath the clamping levers of the clamping carriage.

12 Claims, 7 Drawing Sheets

SEWING SYSTEM HAVING A DEVICE FOR THE PRECISE EDGE ALIGNMENT OF SEWING MATERIAL ALONG A STOP STRAIGHTEDGE

BACKGROUND OF THE INVENTION

1. Field of the Invention

The present invention relates to a device for precise edge alignment of sewing material along a stop straightedge.

A forward edge of the sewing material may be folded over, where it is to be placed along the straightedge. In a feed device, the material is placed on a support and aligned along the straightedge, and then it is grasped by material clamps in a clamping carriage, for being held while sewing operations are carried out.

2.Background Art

A device for aligning sewing material of this general type is known from German Utility Model No. 88 07 378 (corresponding in part to U.S. Pat. No. 4,945,843). (The disclosures of all prior art materials mentioned herein are expressly incorporated by reference.) That known device consists essentially of a table top which serves as support for the sewing material to be used, a stop straightedge arranged on the table top, and four alignment devices arranged on the table top, said devices being entirely identical to each other. Essential parts of each alignment device are a double-acting compressed-air cylinder fastened on the table top as well as an alignment finger made of spring sheet-metal which is fastened to the retractable and extendable piston rod of the compressed-air cylinder. The alignment finger is secured against rotation with respect to its reciprocating movement and is so pivoted that an arcuate hook arranged on the free end of the alignment finger is in a raised position above the table top when the piston rod is extended, while, when the piston rod is retracted, the arcuate hook descends in the direction toward the sewing material until it engages the fold edge of the sewing material toward the end of the movement of retraction. Since the four alignment devices are arranged transverse to the stop straightedge, the material placed on the table top, after the arcuate hooks have acted on the folded edge of the double-folded seam on the sewing material, is pushed against the stop straightedge by the piston rods which retract further into the compressed air cylinders. In this way, a final dependable alignment of the sewing material on the stop straightedge is made possible.

In order to dependably advance the sewing material in the direction toward the stop straightedge for the purpose of edge alignment, it is necessary for the fold edge of the material, for instance a button strip on the front part of a shirt, to be formed by a double-folded seam. The arcuate hook of the alignment finger can dependably act only on such a very pronounced fold edge.

A significant disadvantage of the known device resides in the fact that with single-folded seams, such as on the button strips of the front parts of shirts or blouses, and frequently on buttonhole strips, accurate edge alignment of the material along a stop straightedge is not possible.

Additional background disclosures showing the alignment of sewing material along a stop edge by using a stream of gas in the form of jets of gas or air entering a suction chamber, are found in U.S. Pat. No. 3,886,877 and Germany 33 25 389 C2, which disclose the application of background alignment principles at edge guide devices for workpieces to be sewn.

Federal Republic of Germany OS 23 65 216, corresponding in part to U.S. Pat. No. 3,886,877, discloses providing compressed-air nozzles in cooperation with a material-guide apparatus, the blown air emerging from the nozzles for supporting the movement of the material during its passage through the guide apparatus.

SUMMARY OF THE INVENTION

It is therefore an object of the present invention to develop a device of this type with which accurate edge alignment and subsequent shift-free transfer of an aligned workpiece of sewing material is possible.

A further object is to develop a device with which accurate edge alignment can be accomplished in an automatic operation mode without either mechanical means or the fingers of the machine operator contacting the part of the workpiece to be aligned.

Another object is to develop a device capable of accurately aligning workpieces made of a wide variety of types of material; and accurately aligning, for example, a workpiece with either a single-folded seam or a double-folded seam.

Yet another object is to provide a device for accurately aligning sewing material workpieces against a stop straightedge.

These and other objects are achieved by a device in which the stop edge, preferably a straightedge, is capable of applying suction, preferably serving as a suction chamber. The stop edge may be mounted swingably on a frame of the sewing system, for being swung into position for stopping the sewing material.

The overall sewing system may comprise a clamping unit which is fastened on the support of a feed device and has a plurality of clamping tongues arranged alongside of each other and swingably mounted in the clamping unit. In addition, a clamping carriage may be mounted for displacement on the frame of the sewing system and have a plurality of vises arranged alongside of each other, each vise having a clamping lever which can be lowered to clamp the sewing material when the sewing operations are carried out.

By the device in accordance with the invention, the advantageous result is obtained that, particularly in the case of materials of a thin, sensitive character, for instance shirts or blouse front parts of silk or microfiber fabric, accurate edge alignment along a stop straightedge can be effected without contact and therefore without direct action of mechanical parts or the machine operator on the material. In this way, the alignment process is not affected by the shape of the seam (for example, single- or double-folded), or by the type of sewing material.

Because the operation of the device is automatic, the accuracy of alignment of the sewing material is independent of the accuracy with which the operator places the material in the device; and further, the stress on the machine operator is reduced. Automatic operation also leads to increased productivity.

A further advantageous feature is that the upwardly swung stop straightedge extends upward past an arm provided on the feed device support, thereby defining a region in which a plurality of groups of holes are provided in the stop straightedge. Each group of holes includes a plurality of suction holes. This allows the alignment movement to be concentrated on specific areas, which is useful for example in operations like button sewing or buttonhole sewing.

Further, overlying each group of holes like a roof is the corresponding lowered clamping tongue, which rests, in this connection, on the upward swung stop straightedge. The construction of the device with these features allows the clamping tongue securing the aligned workpiece on the support of the feed device to be raised and lowered without an arrangement of individual drives. Moreover, the area in the close vicinity of the suction chamber opening will be restricted, thus concentrating the air blast entering the suction chamber to increase its effective alignment of the workpiece.

According to a further advantageous feature, each clamping tongue may be provided on its top side with at least one compressed-air feed, that feed passing forwardly and obliquely through the top of the corresponding clamping tongue, and debouching in an outlet opening on the bottom of the clamping tongue. This feature provides additional forces for aligning the workpiece due to the additional air blast. Thus the device can be fitted to be used with different workpiece materials or fabrics.

Preferably there is an actuation device or spring in the feed device for lifting the clamping tongues off of the sewing material workpiece. With this feature it is possible to lift the clamping tongue off of the workpiece as soon as it is taken over by the clamping carriage.

The support of the feed device preferably has recesses in a comb-like arrangement into which the clamping levers can be moved during takeover of the workpiece, and the clamping tongues are located opposite to the recesses. This feature allows intermeshing of the feed device holding the aligned workpiece and the clamping carriage taking over the aligned workpiece. Thus, favorable conditions will be achieved for taking over the workpiece without distortion.

The clamping levers are advantageously carried in the vise in a slide-pivot guide including a transverse slot and a bearing pin, and a slide-pivot bearing, resulting in low cost and reliable construction of the clamping elements which take over the workpiece.

Other objects, features and advantages of the present invention are disclosed and claimed herein and will become apparent from the following description of embodiments of the invention, with reference to the accompanying drawings.

BRIEF DESCRIPTION OF THE DRAWINGS

FIG. 4.1 is an enlarged sectional view showing a portion of FIG. 4, showing the stop part in a raised operating position;

FIG. 4.2 is a view corresponding to FIG. 4.1, but including a received workpiece, and the stop part being positioned in its lowered rest position;

DETAILED DESCRIPTION OF THE INVENTION

Figure 1:
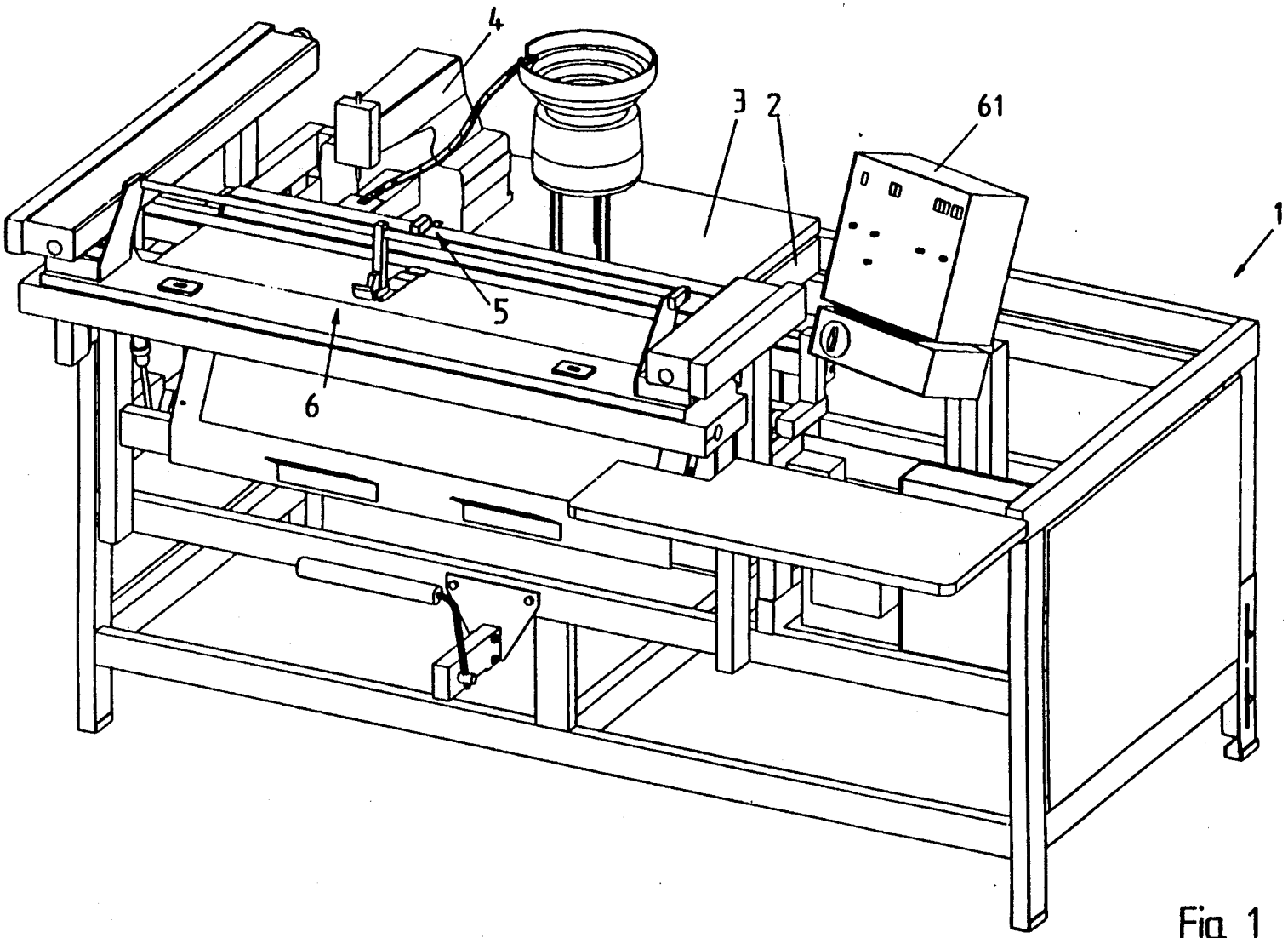
FIG. 1 is a perspective view of an entire sewing system including a device (shown in simplified form) for correct edge alignment and transfer of the sewing material according to an embodiment of the invention.

FIG. 1 shows a sewing system which incorporates an embodiment of the invention. Certain components of the sewing system are known already from German Patent DE 38 19 227 C1, which discloses a machine for the successive production of groups of stitches in a piece of material, for instance a shirt or blouse front part. The sewing system of FIG. 1 includes the following components: a frame 1, a carriage 2 mounted displaceably on the frame, a plate 3 mounted on the carriage and on which a stitch-group sewing machine 4, for example, an automatic buttonhole sewing machine or automatic buttonhole machine, is fastened, a clamping carriage 5 mounted displaceably on the frame, and a feed device 6.

Figure 2:
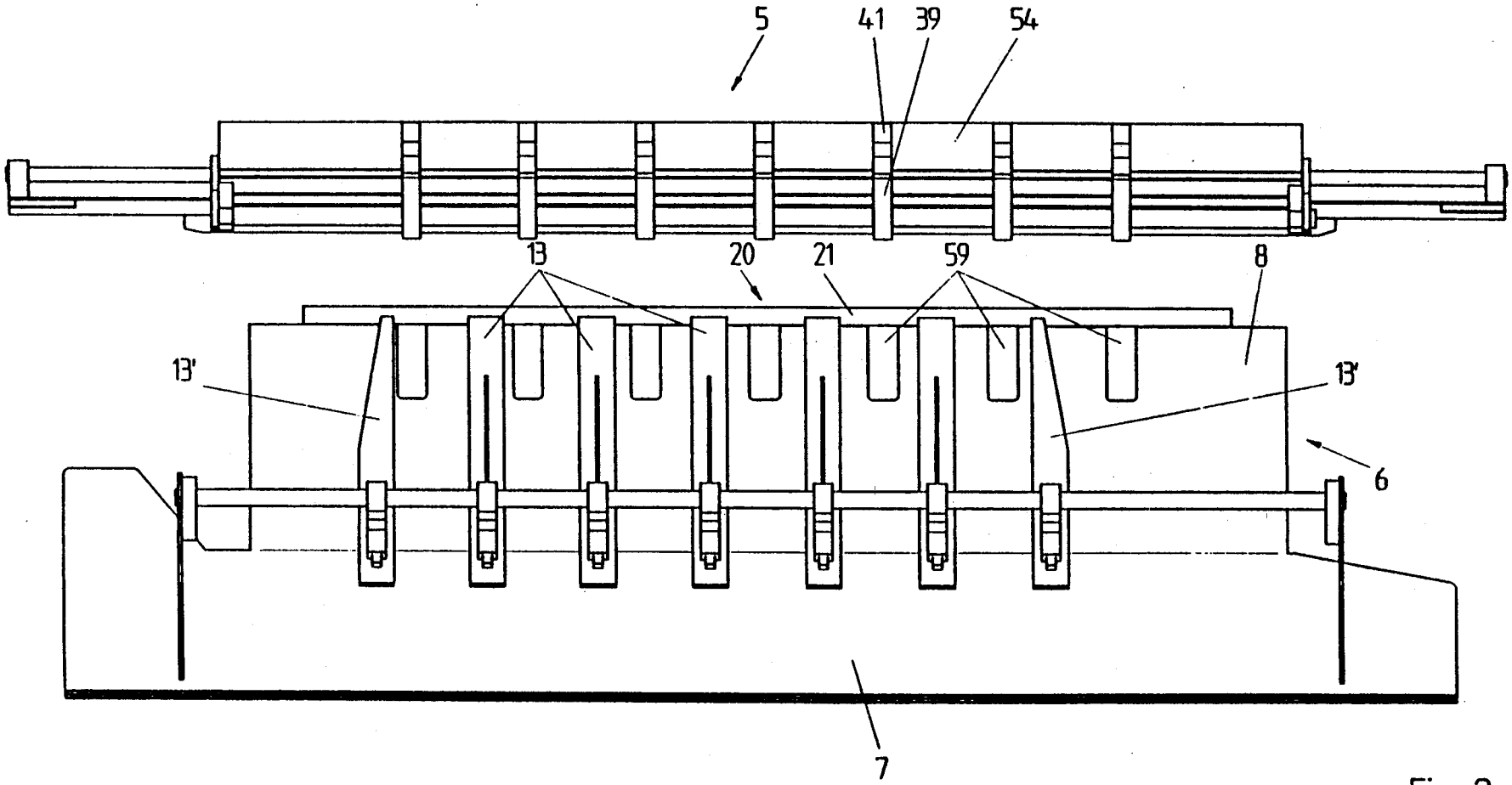
FIG. 2 is a top view of the aligning and transfer device.
Figure 3:
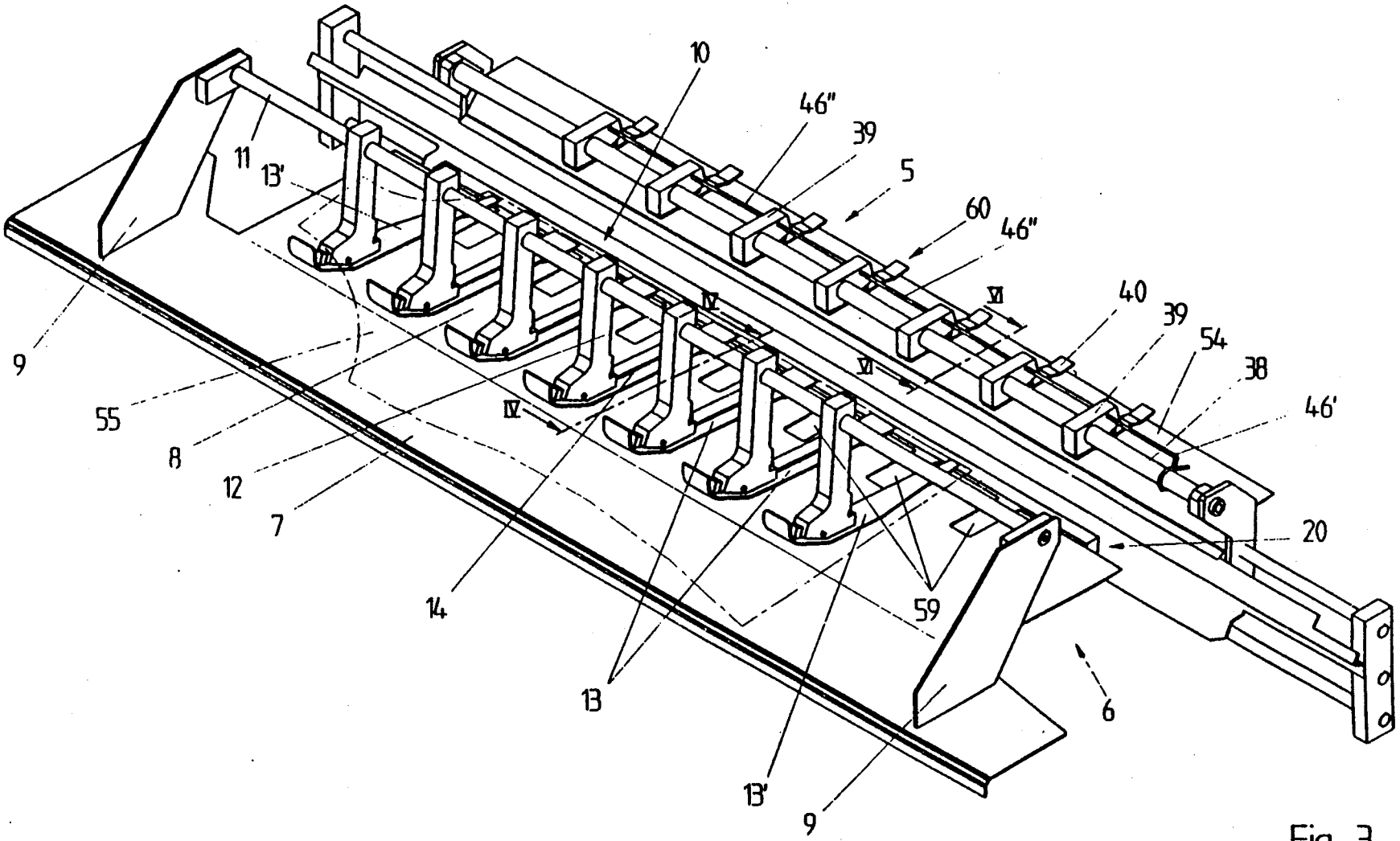
FIG. 3 is a perspective view of the aligning and transfer device.

Referring to FIGS. 2 and 3, the feed device 6 has a support 7 having an arm 8 which is bent downward at a slight angle in its front region, two extensions 9 fastened on the support 7, and a clamping unit 10 arranged between the two extensions 9. The clamping unit 10 has a rod 11 and a plurality of clamps 12 which are connected in force-locked manner to the rod 11. Each clamp 12 has a swingable clamping tongue 13 or 13'. The construction and manner of operation of some components of the feed device 6 and the clamps 12 is known from Federal Republic of Germany 38 19 277 C1, so that a more detailed description thereof can be dispensed with here.

Figure 4:
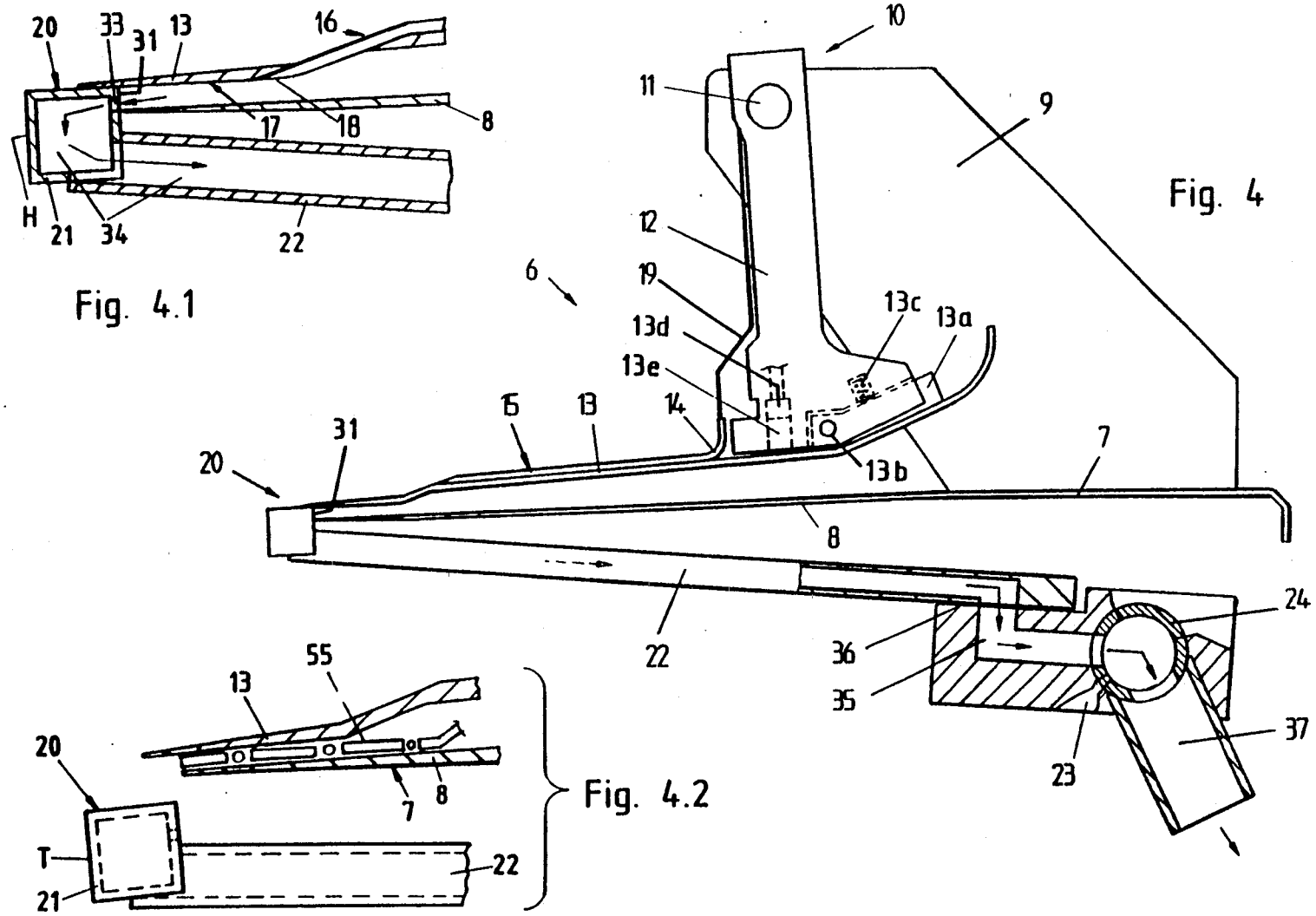
FIG. 4 is a simplified sectional view of the feed device taken along the section line IV—IV in FIG. 3.

As shown in FIG. 4, at least one compressed-air feed 14 is provided on each clamping tongue 13, the compressed-air feed 14 being formed by a length of pipe which is fastened, for instance by soldering, to a top side 15 of the clamping tongue 13. At a slightly inclined region 16 (FIG. 4.1), the feed 14 passes through the clamping tongue 13, as a result of which the feed 14 debouches at a bottom side 17 of the clamping tongue 13 into an outlet opening 18. The feed 14 communicates, via a length of hose 19, with an external source of compressed air (not shown here). The two clamping tongues 13' provided at the two ends of the clamping unit 10 do not have a compressed-air feed 14. It is not necessary, because the operator will ordinarily place the sewing material 55 to be fed by holding it at its two ends in the vicinity of the two clamping tongues 13'. The sewing material will be placed along a stop straightedge 20 while it is in a raised position, denoted herein its acting or operating position. For reasons of easier handling, therefore, the clamping tongues 13' shown in FIGS. 2 and 3 have correspondingly shaped bevels, i.e., the clamping tongues 13' are formed smaller at their ends toward the clamping carriage 5.

According to FIG. 4, the clamping tongue 13 is provided with a web **13*a*, received with play in a cut-out (not numbered) of the clamp 12 and rotatably connected to the latter by a pin 13*b*. In the clamp 12 is pivoted a compression spring 13*c* which rests with its free end on the web 13*a*. The spring 13*c* tends to rotate the clamping tongue 13 in a clockwise direction. The clamp 12 also has a compressed-air cylinder 13*d*, the piston 13*e*** of which tends to rotate the clamping tongue 13 in a counterclockwise direction upon application of pressurized air.

Figure 5:
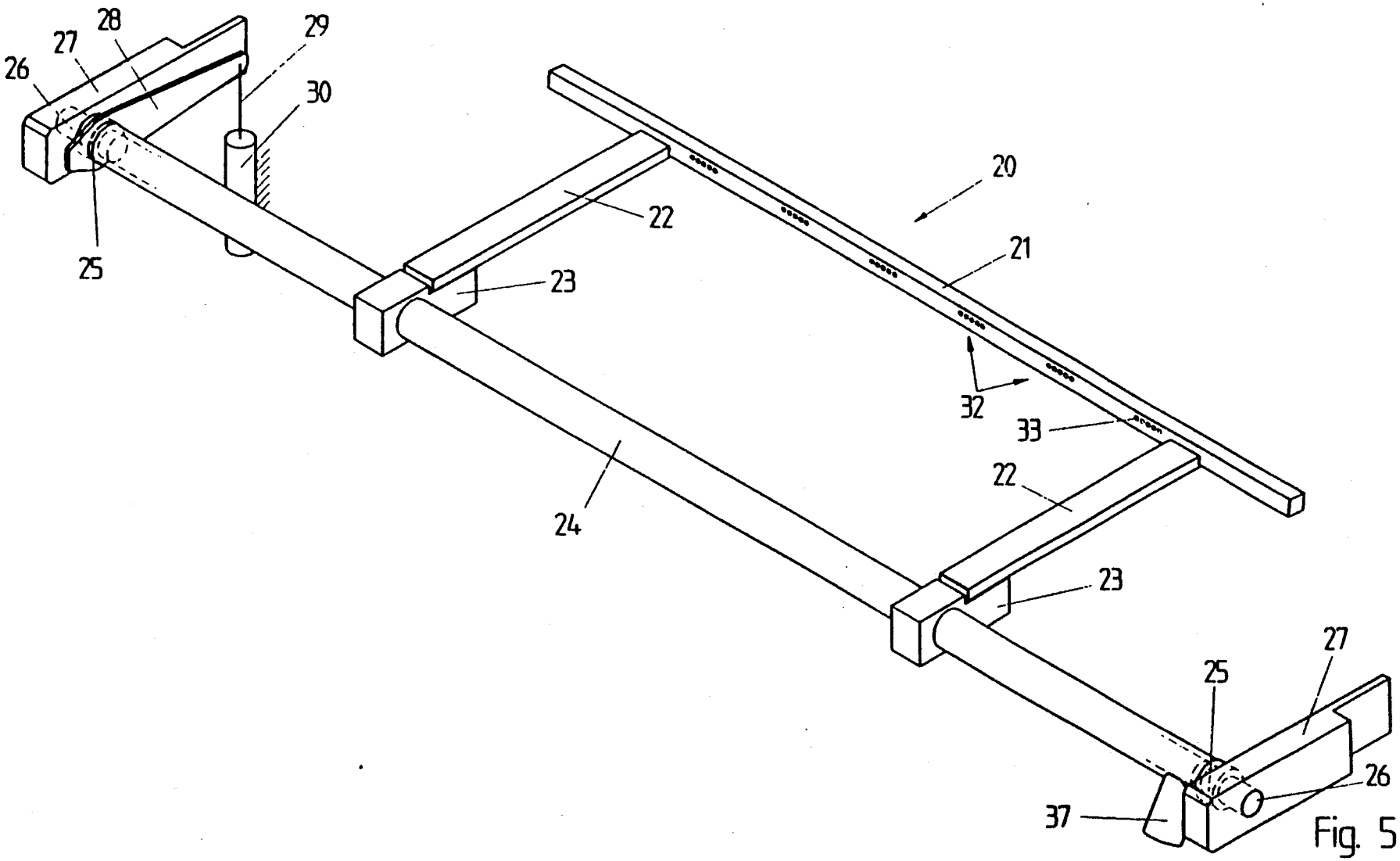
FIG. 5 is a simplified perspective view of the swingable stop straightedge.

The stop straightedge 20, which can be noted in FIGS. 4 and 5, includes a traverse 21 and two cross struts 22 firmly connected with it. The struts 22 are fastened, as shown in FIG. 5, in force-locked manner by fastening means (not shown here) to respective holding blocks 23. Firmly attached to the two holding blocks 23 there is a pipe 24, the two ends of the pipe 24 being closed by covers 25. Each cover 25 has a pin 26 which is mounted turnably in a support 27. Both supports 27 are fastened on the frame 1.

As shown in FIG. 5, a lever 28 is also rigidly fastened to one of the two covers 25, and a piston rod 29 of a compressed-air cylinder 30, arranged fixed on the frame, is pivoted via a pivot connection to the free end of the lever 28. By the action of the cylinder, the stop straightedge 20 is swung in such a manner that it is displaceable from the acting position H (see FIG. 4.1) into a rest position T (see FIG. 4.2) and vice versa. In the acting position H the stop straightedge 20 protrudes past the upper side of the support 7 of the arm 8 to define a region 31.

In the region 31 there are several groups of holes 32, each of the groups 32 including a plurality of adjacent suction holes 33. The groups of holes 32 are arranged in the traverse 21 so that they are covered by the corresponding lowered clamping tongue 13 which rests like a roof on the top of the raised stop straightedge 20. The stop straightedge 20, namely the traverse 21 as well as the two cross struts 22, functions as a suction chamber 34. The traverse 21 and cross struts 22 are produced, for instance, from square pipe. The two ends of the traverse 21 are closed by known sealing means and the place of connection between the traverse 21 and each corresponding cross strut 22 has a passage opening (see FIG. 4.1). Within the holding block 23 there is an angular hole 35 which has, at one end, a passage opening into the suction chamber 34 in the cross strut 22 and, at the other end, another passage opening into the pipe 24 (see FIG. 4). Between the cross strut 22 and the holding block 23, a seal 36 is provided at the corresponding place of connection.

On the pipe 24 is also an outlet socket 37 (FIGS. 4, 4.1 and 5) which is connected via a hose to a vacuum generator, for instance an ordinary commercial ejector nozzle. This last-mentioned hose, as well as the ejector nozzle, are not shown here, for reasons of simplification. The stop straightedge 20, the holding block 23 and the pipe 24 form a self-contained suction chamber system, the inlet of which is the groups of holes 32 provided in the traverse 21 and the outlet of which is the outlet socket 37 provided on the pipe 24.

Figure 6:
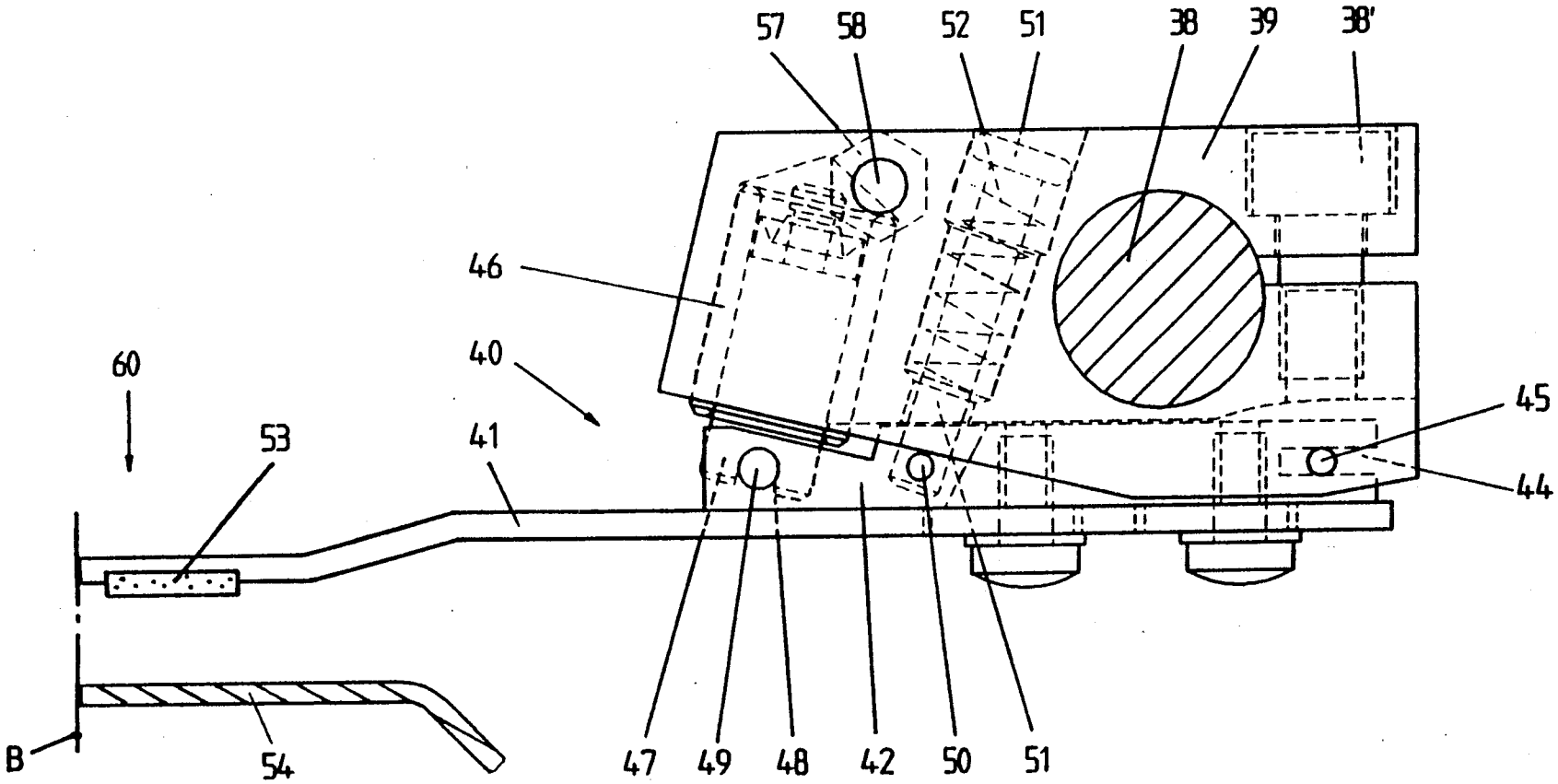
FIG. 6 is a sectional view of the clamping carriage taken along the section line VI—VI in FIG. 3.
Figure 7:
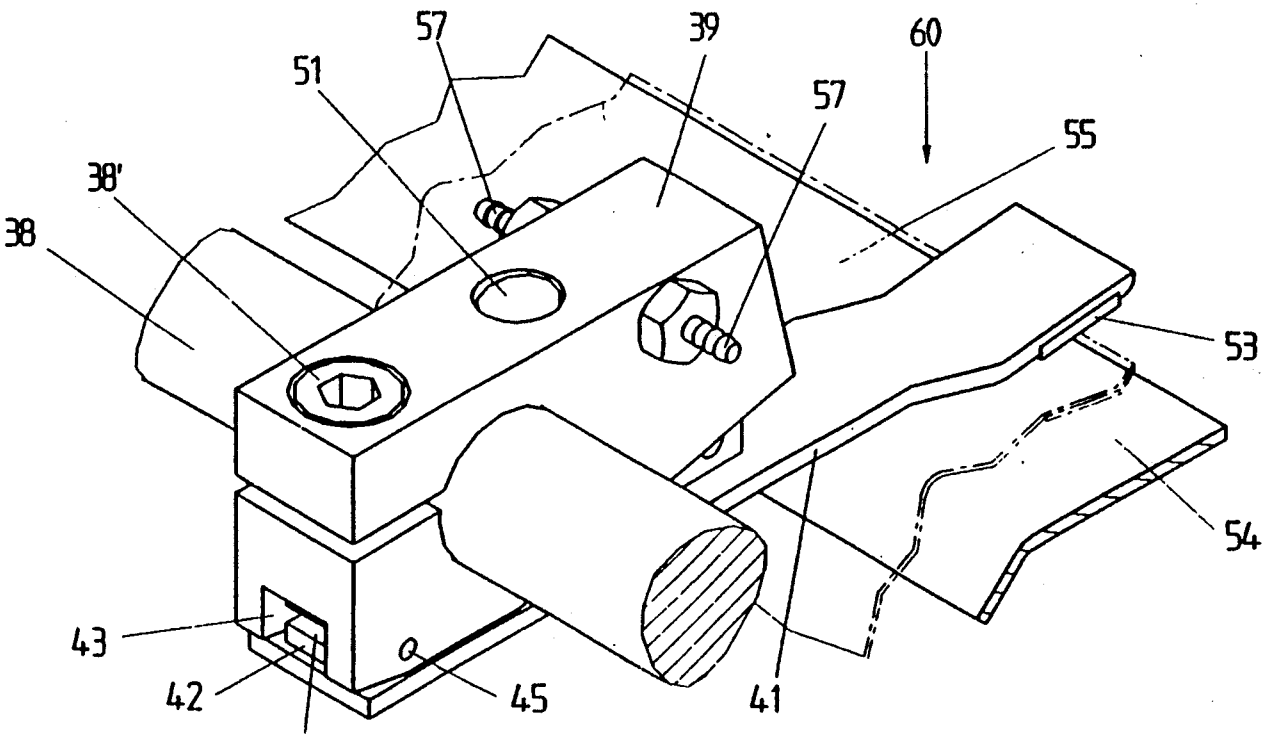
FIG. 7 is a simplified perspective view of the vise and the clamping lever mounted in it.

Another component part of the invention is the aforementioned clamping carriage 5 (FIGS. 2, 3, 6 and 7). The clamping carriage 5 includes a plurality of vises 39 clamped on a holding bar 38 by a screw 38', each of which receives a clamping lever 40 in form-locked manner. The clamping lever 40 has a strap 41 and a block 42 rigidly connected to the strap 41. Within the vise 39 is a groove 43 which receives the block 42, and thus the clamping lever 40, in form-locked manner. On the rear end of the block 42 there is a transverse slot 44 which, as shown in FIG. 6, surrounds a bearing pin 45 force-fitted in the vise 39. With the described construction, the transverse slot 44 and the bearing pin 45 form a slide-pivot guide. In this way, the clamping lever 40 can carry out a sliding movement with respect to the vise 39 within a well-defined region.

As shown in FIG. 6, another single-acting compressed-air cylinder 46 is arranged in the vise 39. The cylinder 46 has a plunger-like piston with a piston rod 47. Due to the arrangement of the cylinder 46 in the vise 39 the piston rod 47 can move in and out on an oblique path. On the free end of the piston rod 47 is a U-shaped recess 48 which surrounds a pin 49 force-fitted in the block 42, as a result of which the compressed-air cylinder 46 is functionally connected to the clamping lever 40. With the described embodiment the straight-line guided piston rod 47 and the pin 49 form a slide-pivot bearing.

Another pin 50 in the block 42 serves as pivot point for a setbolt 51 which, as shown in FIG. 6, is loosely mounted in oblique position in the vise 39, a head 51' of the setbolt 51 being barrelled. The front part of the setbolt 51 which extends out of the vise 39 is pivotally connected to the pin 50. A compression spring 52 over the setbolt 51 opposes the lowering motion of the clamping lever 40 which takes place on an oblique path, always in opposition to the spring force of this compression spring 52.

On the front end of the clamping lever 40 there is a pressure pad 53 of pressure-elastic plastic or rubber which is positionable in abutment with a support plate 54 as a part of the clamping carriage 5.

With the described suspension of the clamping lever 40 at the vise 39, i.e. at the slide-pivot-guide and the slide-pivot-bearing, the front end of the strap 41 carrying the pressure pad 53 is able to be displaced with a nearly parallel movement upon pressurizing the compressed-air cylinder 46. Thus, the parallel movement is performed on an almost straight-line path B perpendicular to the support plate 54 (FIG. 6).

The pressure pad 53 and a support plate 54 forming part of the clamping carriage 5 cooperate to nonshiftably clamp a folded piece of material 55, the resting edge 56 of which has been previously aligned properly along the stop straightedge 20.

For actuating each compressed-air cylinder 46, a hose 46' connects one vise 39, shown at the far right in FIG. 3, to a source of compressed air, not shown here. All further vises 39 also provided on the holding rod 38 are connected to each other by lengths of hose 46'', as shown in FIG. 3. The hose 46', as well as the lengths of hose 46'', are pushed over a pair of hose nipples 57 provided on each vise 39, and the compressed air which is thus fed passes via a hole 58 (see FIG. 6) into the corresponding compressed-air cylinder 46.

The other parts of the clamping carriage 5, which is referred to as a clamping device in Federal Republic of Germany 38 19 277 C1, are thus sufficiently known so that a more extensive description of their construction and operation can be dispensed with here.

A control 61 (see FIG. 1) which forms part of the sewing system ensures the functionally correct application of compressed air to the compressed-air cylinders 30, 13*d*, and 46, as well as the feeding of compressed air into the feeds 14 on the clamping tongues 13 and the production of vacuum for the stop straightedge 20. The control 61 thereby controls the start and duration of the action of the clamping carriage 5 and the feed device 6.

In order to reduce the consumption of compressed air, it is advisable to permit the blast of air fed into the feeds 14 as well as the suction air for the formation of the vacuum in the stop straightedge 20 to flow only after proper edge alignment of the material 55 placed on the support 1. In this connection, it is preferable for the compressed air to be produced by suitable conventional pneumatic equipment, such as throttle valves, water separators and the like, not shown or described here, as well as solenoid valves for the feeding of the compressed air.

The manner of operation of the device for the proper edge alignment and shift-free transfer of a piece of material 55 will now be described:

In an initial machine condition, no workpiece is present in the sewing device and the feed device 6 is positioned relative to the work holder 60 (clamping carriage 5) as illustrated in FIG. 3. At this time the compressed air cylinder **13*d* is pressurized. Thus the clamping tongues 13 and 13' are tilted in counterclockwise direction against the associated springs 13*c*, so the clamping tongues 13, 13' come into contact with the arm 8 of the support 7. The compressed-air cylinder 30 is now in the retracted position, so the stop straightedge 20 is positioned in its lowered position, i.e., in the rest position T. Further, it is assumed that the compressed-air cylinder 46 is now depressurized so that the pressure pad 53 is positioned above the support plate 54 (see FIG. 6**).

Next, to prepare for the material 55 to be placed in the feed device 6, on the arm 8 of the support 7, the compressed-air cylinder 30 is actuated, whereby its outward moving piston rod 29 swings the stop straightedge 20 into its acting position H via the lever 28 (see FIGS. 4 and 4.1). Due to the dimensions of the compressed-air cylinders 30 and 46 and the actuated driven parts thereof, the stop straightedge 20 is capable of lifting, with its traverse 21, the front ends of the clamping tongues 13, 13', against the force of the actuated compressed-air cylinder **13*d*. The conditions before and after the stop straightedge 20 is moved into its acting position H are illustrated in FIGS. 4.2 and 4.1**, respectively.

Figure 8:
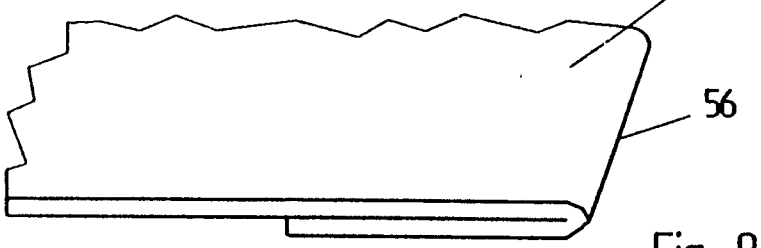
FIG. 8 is a view showing sewing material provided with a single-fold seam.

In the acting position H, the traverse 20 lifts the clamping tongues 13, 13' so as to define a region 31 of the stop straightedge 20 for receiving the material 55 (see FIG. 4.1). The region 31 extends upward past the support 7, and in particular, upward past the top of the arm 8. The operator places the material 55, grasped by him in the vicinity of the two clamping tongues 13', along the stop straightedge 20. At this time, a vacuum is developed in the stop straightedge 20 by the vacuum generator and at the same time a jet of air, directed obliquely to the stop straightedge 20, emerges from each clamping tongue 13, striking the material 55. Due to the suction and blowing action, the material is dependably pulled, without contact by the operator, along the entire application edge 56 (FIG. 8) toward the corresponding edge of the stop straightedge 20. The movement of the material 55 directed toward the stop straightedge 20 is highly effective for the reason that a corresponding outlet opening 18 for the jet of air is located directly opposite each group of holes 32 at which the suction action is produced. In this way, eddying of the air jet on the stop straightedge 20 is prevented. The suction and blowing action onto the workpiece to be aligned is increased in such a way that the stop straightedge 20 with the traverse 21 as positioned in its acting position H, in connection with the arm 8 supporting the workpiece 55 and the lifted-up clamping tongues 13, 13', form separated narrow cross-sections, thus compressing the air jet (combination of suction air and blowing air) into a high velocity.

The described eddying would negatively affect the proper edge alignment, particularly in the case of very thin material, for instance silk or microfiber fabric. Nevertheless, it has been shown that with certain fabrics or materials, the alignment can be improved if only suction air is activated.

After the above-described alignment of the material 55, the compressed-air cylinder 30 is freed of pressure (vented), whereby the stop straightedge 20 is swung into its rest position T in which it no longer extends upward beyond the support 7 and particularly the arm 8. Simultaneously with swinging the stop straight-edge 20 down, the clamping tongues 13, 13' are lowered onto the material 55 which has previously been placed on the arm 8 and aligned. The lowering of the clamping tongues 13, 13' is caused by the force of the compressed-air cylinder **13*d***.

After the above-described fixing of the aligned material 55 on the arm 8, the feed device 6 is moved, in the manner already known from Federal Republic of Germany 38 19 277 C1, in the direction toward the clamping carriage 5, the clamping levers 40 being in the raised position shown in FIG. 6. The feed device 6 moves into such a forward position that the recesses 59 in the arm 8 (FIG. 2) surround the corresponding vises 39 in comb-like manner. In this way, the material 55 which is held between the arm 8 and the clamping tongues 13, 13' is able to move so far into the clamping carriage 5 that the material 55 is located properly between each pressure pad 53 and the support plate 54 (see FIG. 7).

When the feed device 6 has reached its forward position, the compressed-air cylinders 46 are actuated, whereby the clamping levers 40, together with the pressure pads 53, move down onto the material 55 and the support plate 54. Since the lowering movement along the path B is carried out on the path B, shifting of the edge-aligned material 55 upon transfer to the clamping carriage 5 is prevented. The lowered clamping levers 40 in coaction with the support plate 54 in this condition assume the function of a multi-member material clamp 60.

After the placing of the clamping levers 40 on the material 55, the compressed-air cylinders **13*d* in each clamp 12 of the clamping body 10 are vented, whereby the tips of the clamping tongues 13, 13' now no longer press on the material 55 and the arm 8 of the support 7 due to the action of the spring 13*c*. The feed device 6 now returns to its starting position, shown in FIGS. 2 and 3, and can be provided with the next workpiece 55 to be sewn on, which material is duly edge-aligned on the stop straightedge 20** in the manner which has been described above.

Shortly before the feed device 6 has reached the starting position which has just been mentioned, the presser foot (not shown here) of the stitch-group sewing machine 4 is lowered onto the material 55 which is held fixed in position in the clamping carriage 5, and thereupon a first group of stitches of several to be produced in the material 5 is sewn. The lowering of the presser foot, as well as the following sewing process, has been described in detail in Federal Republic of Germany 38 19 277 C1 so that further description can be dispensed with here. After the sewing of the last group of stitches, the completely sewn material 55 is automatically removed from the material clamp 60 in the manner known from the above-cited publication and the clamping carriage 5, which has moved back into its starting position, is then provided with the following piece of material 55, which in the meantime has been edge-aligned in the feed device 6.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A sewing system having a device for the precise edge alignment of sewing material along a stop edge, for locating the material to be taken over by material clamps after being placed on a support surface and aligned, the aligning device comprising:

a stop edge having suction means for drawing the sewing material toward the stop edge, the stop edge being mounted on a frame of the sewing system so as to be swingable into a stopping position adjacent a support surface for supporting the sewing material to be aligned; and clamping mans on said support surface for clamping the sewing material to said support surface after alignment.

2. The system of claim 1, wherein the suction means includes a suction chamber, the suction chamber having a main portion thereof which is structured so as to serve as the stop edge, said main portion of said suction chamber extending upward past a forward end of said support surface when said stop edge is in said stopping position, whereby said main portion of said suction chamber stops the sewing material drawn by the suction means.

3. The system of claim 2, wherein said main portion of said suction chamber has a plurality of groups of holes, each group having a plurality of suction holes.

4. The system of claim 3, wherein said clamping means includes a plurality of clamping tongues; each group of holes having a corresponding clamping tongue, which rests, in a stopping position, on the upwardly swung stop edge, whereby said clamping tongue forms a roof-like cover above said corresponding group of holes.

5. The system of claim 4, wherein each clamping tongue is provided on its top side with at least one compressed-air feed for receiving compressed air from an external compressed air source, the feed passing obliquely forward and downward through the corresponding clamping tongue, and debouching in an outlet opening on a bottom side of the clamping tongue, so as to direct compressed air toward the sewing material along the stop edge, and toward the plurality of groups of suction holes.

6. The system of claim 2, further comprising a feed device which is mounted on the support surface, and structured and arranged for feeding the sewing material to material clamps after alignment and clamping of the material by said clamping means, said clamping means including a plurality of clamping tongues arranged alongside of each other and swingably mounted on the feed device, for clamping the sewing material in position along the stop edge.

7. The system of claim 6, wherein the feed device is mounted for displacement on the frame for carrying the sewing material after clamping by the clamping tongues.

8. The system of claim 6, further comprising a clamping carriage mounted for displacement on the frame and having a plurality of vises arranged alongside of each other for receiving the sewing material from the feed device, each vise having a clamping lever which can be lowered onto the sewing material after it is received from the feed device.

9. The system of claim 8, wherein each clamping lever of the vises in the clamping carriage follow a substantially parallel path when lowered onto the sewing material.

10. The system of claim 8, wherein each clamping lever includes a block which is received in form-locked manner by a groove provided in the vise;

a transverse slot which is provided in the block surrounds a bearing pin which is force-fitted in the vise; and a compressed-air cylinder provided in oblique position in the vise is functionally connected to the clamping lever via its piston rod and by a pin force-fitted in the block, and the compressed-air cylinder acts on the clamping lever against the action of a compression spring which is provided in the vise so as to lower the clamping lever onto the sewing material.

11. The system of claim 10, wherein a recess provided on the front end of the piston rod surrounds a pin which is forced-fitted in the block so as to functionally connect the compressed-air cylinder to the clamping lever.

12. The system of claim 10, wherein a setbolt which is mounted obliquely in the vise receives the compression spring, and the free end of the setbolt is pivotally connected via a further pin to the block so as to oppose the lowering of the clamping lever against the action of the compression spring.

* * * * *